US006830491B1

(12) United States Patent
Tomasino

(10) Patent No.: US 6,830,491 B1
(45) Date of Patent: Dec. 14, 2004

(54) WEATHERTIGHT ELECTRICAL CONNECTOR

(75) Inventor: Guy Tomasino, Poplar Bluff, MO (US)

(73) Assignee: Swenco Products, Inc., Poplar Bluff, MO (US)

( * ) Notice: Subject to any disclaimer, the term of this patent is extended or adjusted under 35 U.S.C. 154(b) by 0 days.

(21) Appl. No.: 10/266,947

(22) Filed: Oct. 9, 2002

Related U.S. Application Data

(60) Provisional application No. 60/327,301, filed on Oct. 9, 2001.

(51) Int. Cl.[7] ..... H01R 11/09
(52) U.S. Cl. ..... 439/784; 439/322
(58) Field of Search ..... 439/411, 412, 439/784, 805, 322, 349

(56) References Cited

U.S. PATENT DOCUMENTS

| | | | | | |
|---|---|---|---|---|---|
| 939,501 | A | * | 11/1909 | Hinds | 403/308 |
| 1,646,660 | A | * | 10/1927 | Prince | 439/805 |
| 1,710,416 | A | * | 4/1929 | Goeller | 439/431 |
| 3,577,114 | A | * | 5/1971 | Hawkins | 439/277 |
| 4,204,739 | A | * | 5/1980 | Shoenleben | 439/263 |
| 4,878,855 | A | * | 11/1989 | Heng et al. | 439/411 |
| 5,228,875 | A | * | 7/1993 | Swenson, Sr. | 439/784 |
| 5,695,369 | A | * | 12/1997 | Swenson, Sr. | 439/784 |
| 5,868,589 | A | * | 2/1999 | Swenson, Sr. | 439/784 |
| 6,488,548 | B1 | * | 12/2002 | Tomasino | 439/784 |
| 6,568,952 | B1 | * | 5/2003 | Tomasino | 439/411 |

* cited by examiner

*Primary Examiner*—Hae Moon Hyeon
(74) *Attorney, Agent, or Firm*—Jim Zegeer

(57) ABSTRACT

A weathertight connector for electrical connectors having multiple connection chambers with a conductive element having splaying ends in the connection chambers. One common O-ring and an O-ring for each connection chamber is utilized.

3 Claims, 2 Drawing Sheets

WEATHERTIGHT ELECTRICAL CONNECTOR

REFERENCE TO RELATED APPLICATION

The present application is the subject of provisional application Ser. No. 60/327,301 filed Oct. 9, 2001 and entitled WEATHERTIGHT CONNECTOR.

BACKGROUND AND BRIEF DESCRIPTION OF THE INVENTION

The present invention is directed to a weathertight electrical connector using the positive wire-locking features of U.S. Pat. Nos. 5,228,875, 5,695,369 and 5,868,589 which features are adapted in a unique manner to achieve a weathertight connector.

The electrical connecting of two discrete wires using the positive wire locking features of the above-referenced U.S. patents has been highly successful commercially and sold under the trademark POSI-LOCK by the assignee hereof. In the electrical connectors of the type disclosed in the above-identified patents as well as others, a connection chamber is formed in an non-conductive body and a conductive metal insert is provided which extends between the two connection chambers. The ends of the conductive element in the connection chambers is shaped as a splaying member for splaying a wire on its surface. The interior surface of the connection chamber is threaded for receiving a threaded male member which has a throughbore, and a portion of the throughbore is shaped to form a complementary surface to the bullet-shaped splaying surface. When a wire is passed through the throughbore and engages the splaying surface, it is splayed along the splaying surface and then a male member having a threaded exterior engaged with threaded connection chamber walls to clamp the wire between the shaped splaying surface and the complementary clamping surface formed on the throughbore male member. It is desirable in a number of situations to provide a weathertight seal for the connection chambers.

The object of the present invention is to provide techniques and structures for forming a weathertight connector in which the connection chambers are sealed from the egress of moisture and the like.

In a preferred embodiment of the invention, a movable discrete clamp member is provided with a throughbore having a complementary surface on it for clamping the wire to the surface of the conductive insert. For each connection chamber, there is a clamp member, and each clamp member has a throughbore, one end of which has the aforesaid clamping surface, the opposite end of which has a recess for receiving an O-ring. The O-ring in this instance is in the end of the non-conductive clamp member, which is adapted to fit inside the connection chamber having the internal aperture size designed to closely and snugly fit on the insulation of the wire inserted therein. The external surface of the connection chamber is threaded, and a force member which, in the preferred embodiment, is threadably engaged with the external threads on the body member engages the clamping member to force the clamping member against the wire splayed on the splaying member to thereby clamp the wire between the splaying surface, and the complementary surface in the throughbore. A second O-ring is adapted to be seated in an annular groove located approximate to mid-point between the two connection chambers. Thus, when the two force members are threadably engaged with the external threads on the body member and caused to move inwardly to clamp the wire between the two clamping surfaces on the conductive member, the ends of the force member engage the O-ring to thereby provide a seal for the connection chamber from external ambient environment.

Thus, the invention features a weathertight connector comprising a non-conductive body member having one or more connection chambers formed therein and a conductive element having a pair of ends, each end being positioned coaxially in one of the connection chambers, respectively, and being shaped to form a crimp-free wire connection, the outer surfaces of the non-conductive body member being threaded at each end. A non-conductive clamp member is adapted to be fitted inside the connection chambers, there being one non-conductive clamp member for each chamber. Each non-conductive clamp has an internal surface adapted to coact with the operative member for clamping the wire to the shaped end of the conductive element in the connection chamber. First O-rings are adapted to be seated in each clamping member, respectively, and has an internal aperture size designed to closely and snugly fit on the insulation of a wire inserted therein. A second O-ring member is seated in an annular groove formed in the external surface of the body member and proximate mid-way between the connection chambers. A force member is adapted to be threadably engaged with the external threads on the body member and engage the non-conductive clamp member to force the clamping member against the wires and thereby clamp the wire therein.

BRIEF DESCRIPTION OF THE DRAWINGS

The above and other objects, advantages and features of the invention will become more apparent when considered with the following specification and accompanying drawings wherein.

DETAILED DESCRIPTION OF THE INVENTION

Figures 1, 2:
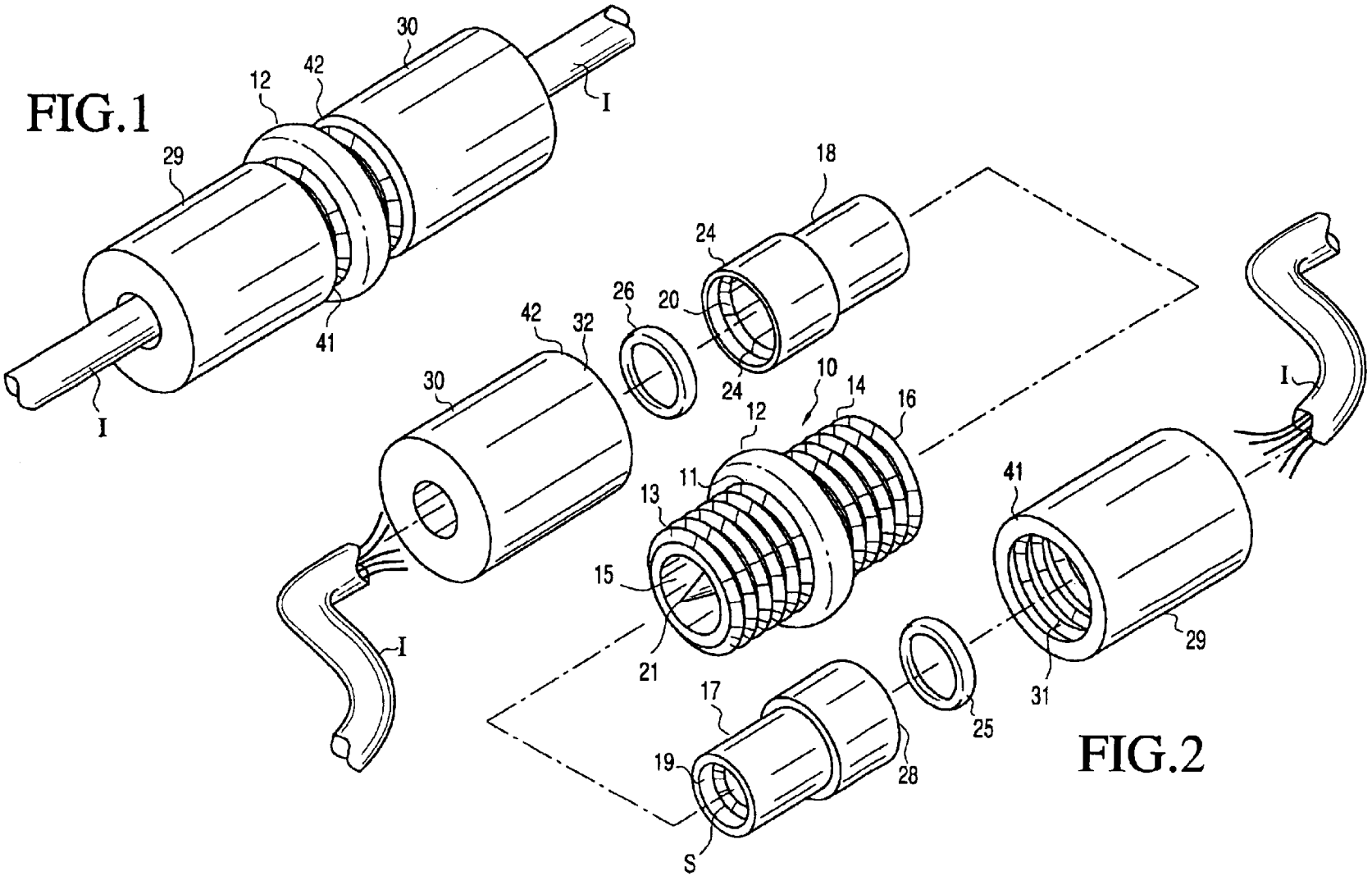
FIG. 1 is an isometric perspective view of a weathertight connector incorporating the invention.
FIG. 2 is an exploded view thereof.

The invention features a non-conductive body member 10 having an annular groove 11 on which is seated an O-ring member 12. The external ends 13 and 14 are threaded and have connection chambers 15 and 16 formed therein. Non-conductive clamp members 17 and 18 are adapted to be fitted inside the connection chambers 15 and 16, respectively; and in the embodiment shown includes a throughbore 19 and 20, the throughbore being adapted at one end to have a complementary internal surface S adapted to coact with the splaying member of a conductive element CE (see FIG. 3) having splaying ends 21, 22. The opposite ends 23, 24 of the clamp member carry O-rings 25, 26 which are adapted to be seated in the clamping member ends 23, 24 and have an internal aperture size designed to closely and snugly fit on the insulation I of the wire inserted therein (see FIG. 3). Force members 29 and 30 have an internally threaded portion 31, 32 which are adapted to engage the threads of the external end 13 and 14, respectively, of the non-conductive body member 10. When the force members are turned (they have grooved surfaces for good gripping) to tighten them on the non-conductive body member 10, clamp members 17 and 18 are engaged by the respective force members 29 and 30, and the clamping member is forced against the wire splayed on the splaying member to thereby clamp the wire between the splaying surfaces 21, 22 and the complementary internal surface S on the force member. At the same time, the ends 41, 42 of the force members engage the central O-ring 12, thereby forming a weathertight arrangement for each of the connection chambers.

Figure 3:
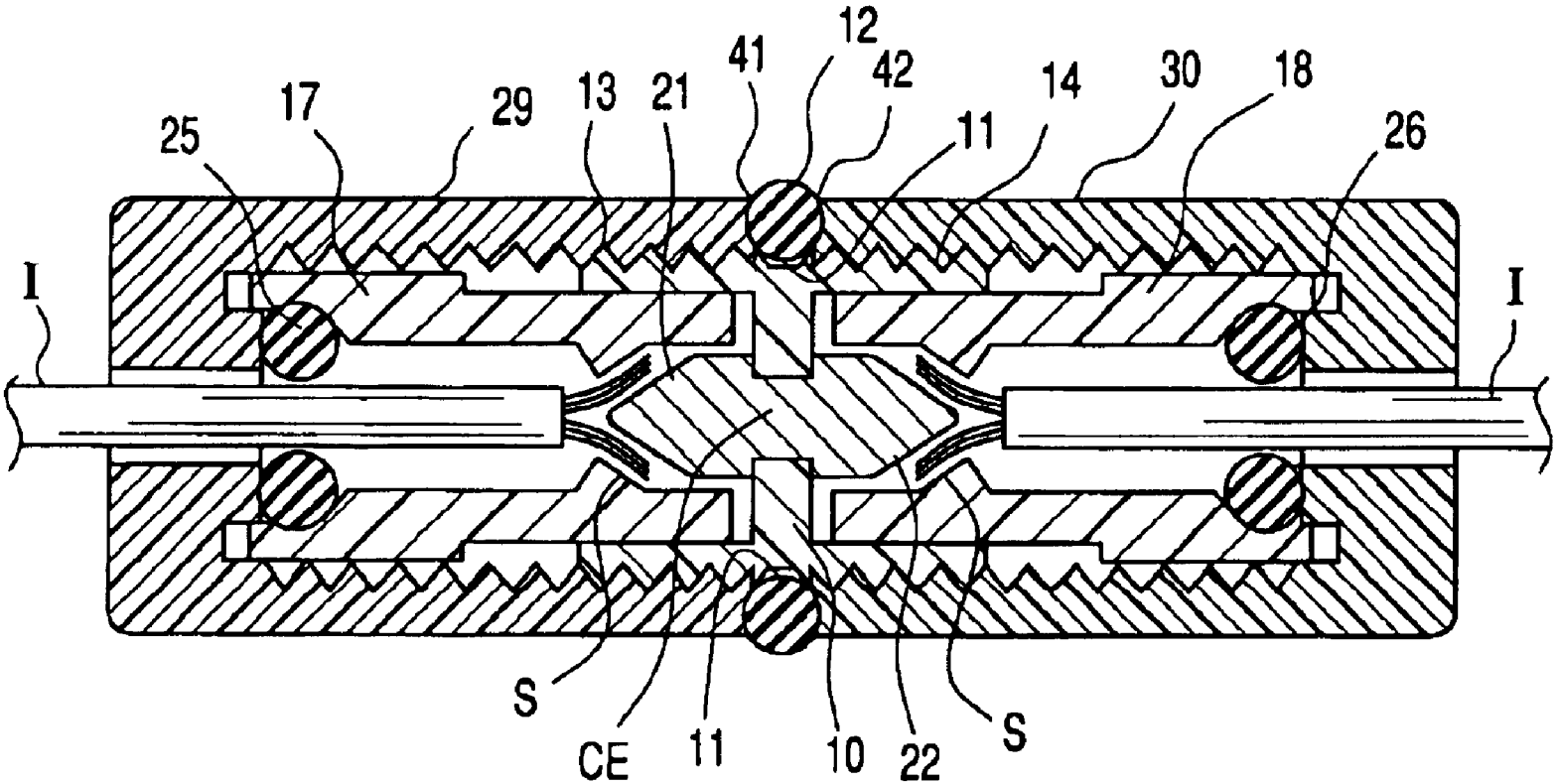
FIG. 3 is a cross-sectional view thereof showing a pair of wires electrically connected in a weathertight situation.

As shown in FIG. 3, the force members 29 and 30 are threadably engaged with the threads of the external end 13 and 14 of the body member 10. At the same time, the force member is bearing down on the O-ring in the ends of clamp members 17 and 18 which, due to the shape of the O-ring chamber, causes the O-ring to close in the grip wire. Thus, two forces are acting on the wire, one the conductive wire strands are gripped tightly between the clamping surface of the splaying ends of the conductive element and the O-ring is gripping the external surfaces of the wire insulation.

Instead of a splaying member, the ends of the conductive element in the connection chambers can be shaped to have a wire bore for receiving a wire and a transversely moved ball clamp element seated in a transverse aperture can be forced by the respective clamp members into clamping engagement with the wire in the wire bore by the nonconductive clamp member.

While preferred embodiments of the invention have been shown and described, it will be appreciated that many other embodiments, adaptations, changes and modifications to the invention can be done by those skilled in the art.

What is claimed is:

1. A weathertight electrical connector comprising a non-conductive body member having two or more connection chambers formed therein and a conductive element having a pair of ends, each end being positioned coaxially in one of said connection chambers, respectively, and being shaped in the form of a crimp-free wire connection member, said non-conductive body member having a pair of externally threaded ends, first and second force members adapted to threadably engage with said external threads on said body member, respectively, and engage and active said clamping member to clamp the wire on said conductive member to thereby clamp said wire to said conductive element, respectively, and first and second O-ring members adapted to be seated in said force members, respectively, and having an internal aperture size designed to closely fit on the insulation of a wire inserted therein, respectively, and a third O-ring member seated in an annular groove on the exterior of the body member mid-way between the connection chambers and engageable by ends of said force members, respectively.

2. A weathertight electrical connector comprising a non-conductive body member having a pair of connection chambers formed therein and a conductive element having a pair of ends, each end being positioned coaxially in one of said connection chambers, respectively, and being shaped in the form of a wire-splaying member, the outer surfaces of said non-conductive body member being threaded at each end thereof, a non-conductive clamp member adapted to be fitted inside said connection chamber and having an internal complementary surface adapted to coact with said wire-splaying member to clamp a wire therebetween, first and second O-ring members adapted to be seated in each said clamp member, respectively, and having an internal aperture size designed to closely fit on the insulation of the wire inserted therein, and each said clamp member including a force member adapted to threadably engage with said external threads on said body member and force said clamping member against the wire splayed on said splaying member to thereby clamp said wire between said splaying member and said complementary surface, respectively, and a third O-ring member seated in an annular groove on the exterior of the body member mid-way between the connection chambers and engageable by ends of said clamp members.

3. An electrical connector comprising a non-conductive body member having a connection chamber formed therein, a conductive element fixedly mounted in said connection chamber and having an end shaped in the form of a wire splaying member, said conductive element being coaxially mounted in said connection chamber, said connection chamber having a threaded external wall, a non-conductive clamp member adapted to be fitted inside said connection chamber and a force member having a threaded internal wall surface adapted to be threadably engaged with said threaded external wall of said connection chamber and having an internal surface adapted to coact with said splaying member to clamp a wire therebetween, the improvement for rendering said connection chamber weathertight comprising:

a first O-ring member coaxially seated in said clamp member and having an internal aperture size to sealingly fit on the insulation of a wire inserted therein, and a second O-ring member seated on the exterior of said body member and engageable by the end of said non-conductive clamp member when said force member is rotated to force said clamping member against the wire splayed on said splaying member to thereby clamp said wire between said splaying member and said complementary surface in a weathertight chamber.

* * * * *